United States Patent [19]

Woskow

[11] Patent Number: 5,009,610

[45] Date of Patent: Apr. 23, 1991

[54] LIGHT SWITCH AND OUTLET GUARD

[76] Inventor: Robert Woskow, 16801 Severo Pl., Encino, Calif. 91436

[21] Appl. No.: 422,147

[22] Filed: Oct. 16, 1989

Related U.S. Application Data

[63] Continuation-in-part of Ser. No. 204,217, Jun. 8, 1988, Pat. No. 4,876,425.

[51] Int. Cl.[5] ..... H01R 13/44

[52] U.S. Cl. ..... 439/142; 439/148; 439/136; 174/67

[58] Field of Search ..... 439/136–139, 439/142, 143, 148; 174/67

[56] References Cited

U.S. PATENT DOCUMENTS

| | | | |
|---|---|---|---|
| 1,003,391 | 9/1911 | Barber et al. | 439/148 |
| 1,875,225 | 8/1932 | Despard | 220/241 |
| 2,515,870 | 7/1950 | Hamilton | 439/139 |
| 2,559,151 | 7/1951 | Getzoff | 220/242 |
| 2,728,894 | 12/1955 | Peters | 439/143 |
| 3,068,442 | 12/1962 | Kubik et al. | 339/36 |
| 4,070,078 | 1/1978 | Chrones | 439/142 |
| 4,102,471 | 7/1978 | Lore et al. . | |
| 4,228,317 | 10/1980 | Cziment | 439/142 |
| 4,302,624 | 11/1981 | Newman | 439/142 |
| 4,363,944 | 12/1982 | Poirier | 200/42 R |
| 4,607,136 | 8/1986 | Thomas | 339/36 |
| 4,671,587 | 6/1987 | Lemer et al. | 439/142 |
| 4,733,017 | 3/1988 | Wolfe-Taylor et al. | 174/67 |
| 4,801,271 | 1/1989 | Piper | 439/142 |

*Primary Examiner*—Paula A. Bradley

*Attorney, Agent, or Firm*—Milton S. Gerstein

[57] ABSTRACT

A protective guard for use with a wall-mounted light switch in order to keep the light switch in the desired "on" or "off" state. The guard is a pivotal arm having at one end an opening for receiving one of the mounting screws of the light switch, by which the guard is pivotally connected to the wall plate of the light switch. When it is desired to allow access to and operation of the light switch, the guard is pivoted out of the way. The same general principle of the invention applies to a guard for selectively closing off a wall plug outlet.

12 Claims, 5 Drawing Sheets

FIG. 11
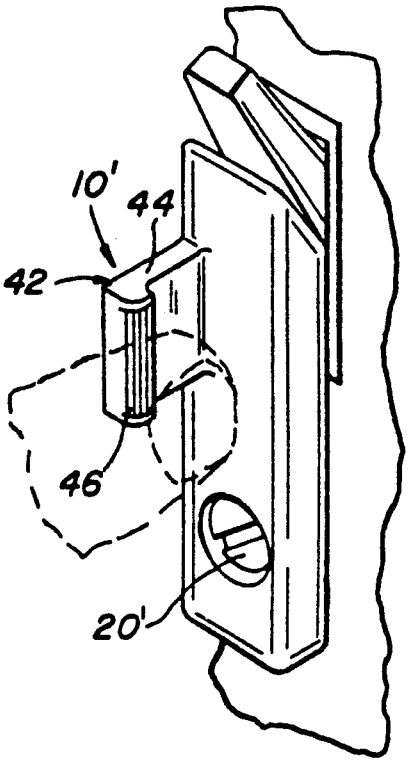
FIG. 12
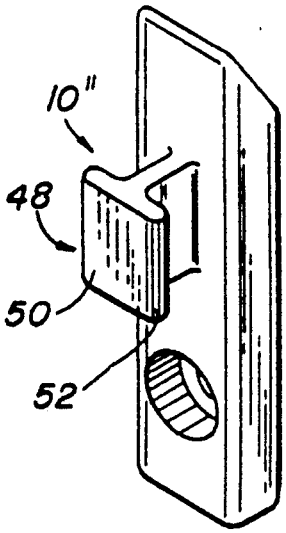
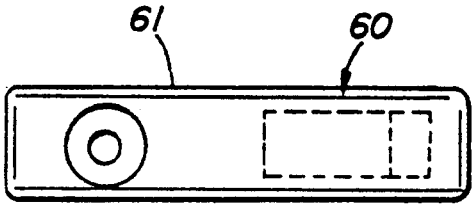
FIG. 13
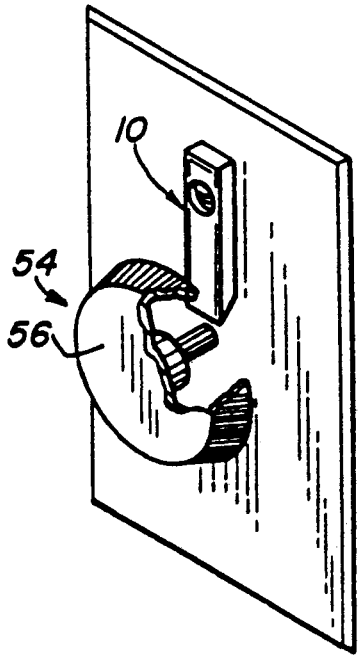
FIG. 14
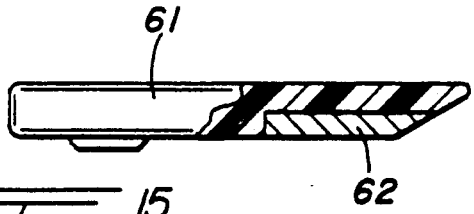
FIG. 15
FIG. 16
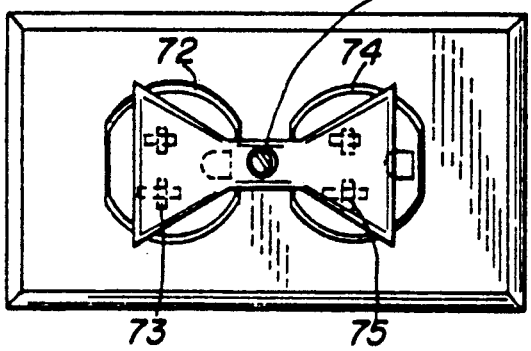

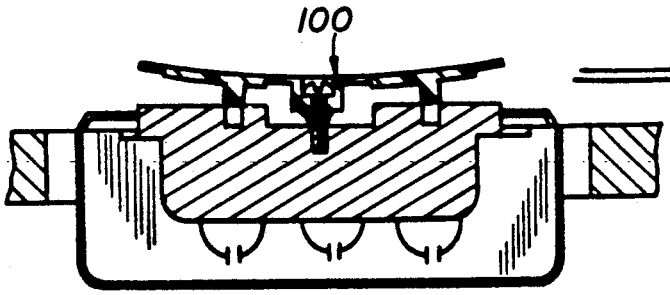
FIG. 23
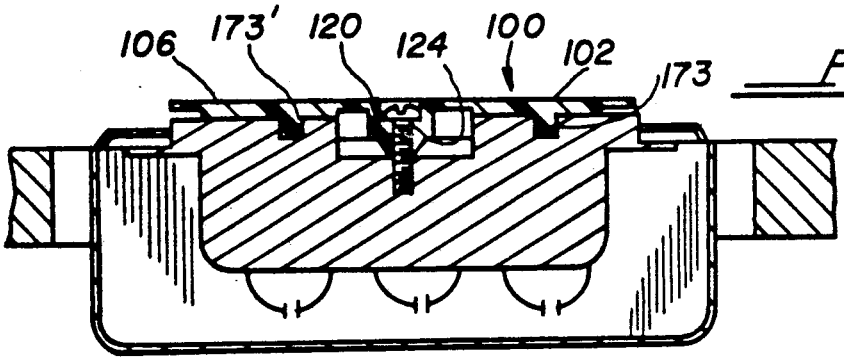
FIG. 24
FIG. 25
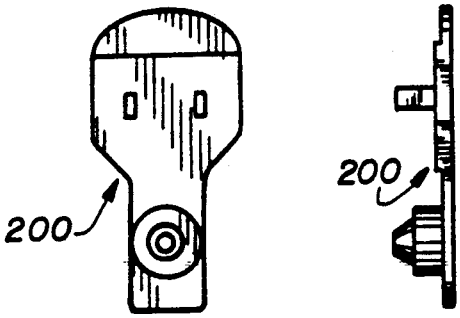
FIG. 26
FIG. 28
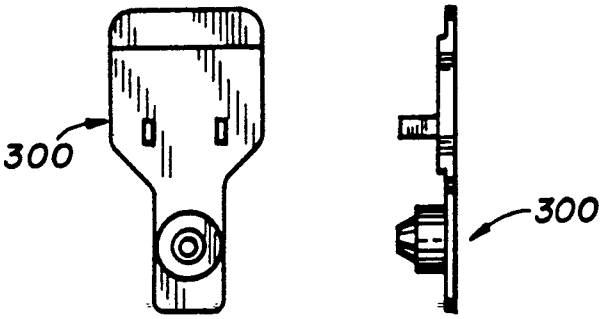
FIG. 29
FIG. 27
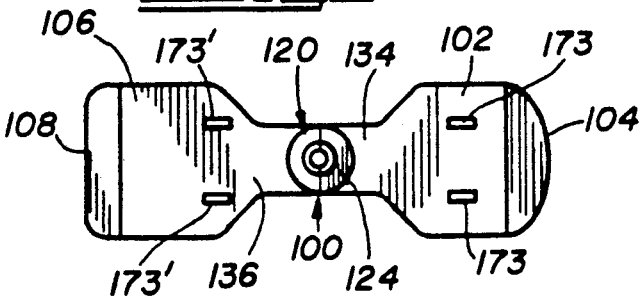

LIGHT SWITCH AND OUTLET GUARD

CROSS-REFERENCE TO RELATED APPLICATION

The present application is a continuation-in-part application of application Ser. No. 07/204,217, filed on Jun. 8, 1988, by the same applicant, and now U.S. Pat. No. 4,876,425.

BACKGROUND OF THE INVENTION

The present invention is directed to a guard for a wall-mounted light switch and plug outlet by which access to the switch or outlet may be selectively prevented. There exist many prior-art types of protectors or guards for light switches and outlets. However, all of these prior-art devices require that the device be entirely removed if unrestricted access to the switch or outlet is to be possible, and, in many of these prior art devices, even when in place in their normal use for guarding the switch so that it can be turned on, still allow access to the switch to turn it on even though it may be disadvantageous. Furthermore, none of these prior-art guards allow for a variable and selected degree of guarding of the switch or outlet, which, if such could and were to be provided, would uniquely suit the guard to the particular individual's needs, strength, frequency of use of the switch or outlet, etc., all of which is possible according to the present invention. Examples of prior-art outlet guards are plastic inserts having male projecting prongs for insertion into the female plug outlet, by which access is prevented. However, these plastic guards are easily removed, are not directly adaptable to changes in the outlet to wear and tear, and, in many instances, are even easily removed by a child or toddler, against whom such were intended to protect. Examples of prior-art switch guards are those defining a side walls on either side of the toggle of the switch, which side walls connect to the main mounting plate fixedly attached to the wall plate or to the wall. Access to the toggle is possible, however, and these prior-art devices only prevent accidental pushing of the toggle. To operate the switch without hindrance requires complete removal of the guard from the wall or wall plate. In addition, these prior-art guards are relatively time-consuming to install, requiring the drilling of holes, proper alignment, etc.

SUMMARY OF THE INVENTION

It is, therefore, the primary objective of the present invention to provide a guard for preventing the operation of a wall-mounted light switch, that, when installed, will prevent operation of the switch in any manner whatsoever.

It is another objective of the present invention to provide such a light switch guard that is easily installed, requiring the small amount of time that it takes to unscrew the wall-plate mounting screw and its re-insertion therein.

It is another objective of the present invention to provide such a guard for a light switch that takes on two easily-assumable states or positions, with the degree of difficulty of the change over from one state to the other state being adjustable simply by adjusting the mounting screw of the switch wall-plate, which screw passes through a hole formed in the guard of the present invention.

It is yet another objective of the present invention to provide such a light-switch guard that is pivotally mounted by the mounting screw of the wall plate thereof, so that the guard of the present invention is pivotal between in its switch-operation prevention state, and its switch-operation access state.

It is still a further objective of the present invention to allow for the same guard of the present invention to be used for guarding against the operation of a toggle switch and a push-button switch.

It is an objective of the present invention to provide a guard for protecting against access to a female plug wall outlet, which guard operates under the same principles as the guard for a light switch.

Toward these and other ends, the guard for preventing operation of a light switch, or the like, has an elongated mounting arm having a first end in which is formed a through-opening. The second, opposite end of the mounting arm is formed into an inner, sloping or canted surface. The through-opening in the first end of the mounting arm allows for the passage therethrough of a wall-plate mounting screw, so that the mounting arm is connected to the wall plate, and which also allows for the pivotal rotation of the mounting arm between the switch-operation prevention state and the switch-operation access state. The ease by which the mounting arm may be pivoted about the mounting screw is easily adjustable by simply rotating the mounting screw in one direction or the other. In the first state thereof, which is the switch-operation prevention state, where the movement of the toggle switch to its "on" position, for example, is prevented, the inwardly-facing canted surface of the mounting arm is in face-to-face contact with the exteriorly-exposed portion of the rotary hub of the switch proper, such that the lowermost end-edge surface of the mounting arm is in surface contact with—or in very near surface contact with—with the toggle-lever of the switch proper, so that the pivotal movement of the toggle-lever is prevented thereby. It is, of course, possible to reverse the states of the mounting arm, such that the surface-to-surface contact above-mentioned occurs in the "on" state of the toggle-lever, so that the switch may not be turned off, which is desirous in those cases where a constant power supply is necessary, such as required by apparatus used in laboratories, hospitals, etc. This is achieved simply by using the other of the two mounting screws of the wall-plate of the light switch, such as the lower screw for a vertically-mounted switch. In either case, when it is desired to operate the switch in its normal fashion, so that the protected-against state may be obtained, one merely pivots the mounting lever through an acute angle to either side of the toggle-lever, whereby the surface-to-surface contact at the canted surface of the second end of the mounting lever is negated, with the canted surface allowing for easy gripping of the mounting arm for such pivotal movement. It is also possible to use two such mounting arms, one for each of the two mounting screws of the switch wall plate, so that both the "on" and "off" states of the same switch may be protected.

The very same guard of the present invention that protects a toggle-switch may also be used for a push-button switch, such as those used in light dimmers. In use in this application, the second end of the mounting arm is placed between the wall plate and wall-facing surface of the push button, so that the push button is prevented from being pushed in the requisite amount to turn the switch on or off, depending upon the state being protected, the thickness of the mounting lever being that suitable for the prevention of such movement of the push button.

In a second embodiment of the invention utilizing the same principles, the guard of the present invention is used to protect against access to a female plug wall outlet. In this embodiment, the mounting arm has a first end with a through-opening for the passage therethrough of a mounting screw of the mounting plate of the outlet, so that the mounting arm is adjustably pivotal, as in the light switch embodiment. The second end of the mounting arm is formed into a triangular or trapezoidal shape which completely covers over the two or three female openings of the outlet, to thereby prevent access. Access thereto is easily achieved by the pivoting of the mounting arm about its pivot defined by the mounting screw of the outlet itself. For a wall outlet having two, side-by-side female plug outlets, two such mounting arms may be used, with the very same wall plate mounting screw being used and passing through the respective through-openings of the two mounting arms, with one arm extending toward one outlet, and the other mounting arm, extending diametrically opposite, covering the other outlet.

BRIEF DESCRIPTION OF THE DRAWING

The invention will be more readily understood with reference to the accompanying drawings, wherein:

FIG. 11 is an isometric view of a modification of the switch-guard of the present invention in which there is provided a knurled, forwardly-projecting protuberance for expediting the pivotal movement of the guard;

FIG. 12 is an isometric view of a modification of the switch-guard of FIG. 11;

FIG. 13 is an isometric view showing the switch-guard of FIGS. 3-7 being used with a push-button switch;

FIG. 14 is a front view of another modification of the switch-guard of the present invention in which there is provided a weighted element at the end of the guard for causing the guard to return by itself to its vertical, preventing state;

FIG. 15 is a side elevational view, in partial cross section of the modification of FIG. 14;

FIG. 16 is a front plan view of the outlet-guard constituting the second embodiment of the present invention, shown mounted to a wall outlet having a pair of side-by-side female plug outlets;

FIGS. 22-29 show still another modification of the wall outlet guard.

DETAILED DESCRIPTION OF THE INVENTION

Figure 6:
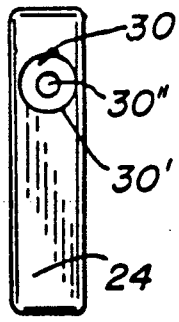
FIG. 6 is a front view thereof.
Figure 7:
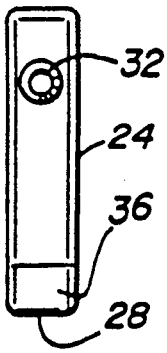
FIG. 7 is a rear view thereof.

Referring now to the drawings in greater detail, the first and preferred embodiment of the light-switch protector of the invention is shown in FIGS. 1-8, and is indicated generally by reference numeral 10. The light-switch protector or guard is preferably made of polystyrene, or other electrically-nonconducting plastic, metal or other conducting material not being preferred, owing to the danger posed by an improperly grounded switch. The use of thermoplastic resin material also allows for easy manufacture by well-known injection-molding techniques, whereby the protector 10 is made as one, integral, whole unit. The light-switch protector 10 is shown in its normal or most-often used environment in FIGS. 1, 2 and 8, which is secured to a conventional, wall-mounted light switch 12 having a wall plate 14, vertically-pivotal lever or toggle 16, and a pair of horizontally-disposed, vertically-separated, mounting screws 18, 20. Each mounting screw 18, 20 passes through a respective hole formed in the wall plate 14, such as hole 22 for the upper mounting screw 18, and projects into the mounting hole formed in the corresponding portion of the wallboard, or the like, behind the wall plate 14. The switch-protector 10 takes the form of an elongated arm or lever 24 defining a first upper end 26 and a second lower end 28. The arm or lever 24, adjacent the upper end 26 has a countersunk opening 30 defining a first larger hole 30' facing interiorly, toward the interior of the room when mounted to a wall-mounted light switch 12. The opening 30 also defines a second, smaller opening 30'' facing exteriorly towards the wallboard, as best seen in FIG. 6. This countersunk opening 30 receives therein a head portion 18' or 20' of the mounting screws 18, 20. The depth of the countersunk opening 30 is only slightly less than the depth or thickness of the lever 24 proper adjacent the upper end thereof, in order that the head portion of the screw may be completely received within the opening 30. This complete entry of the head portion of the screw allows for easy and quicker installation, more aesthetic appeal since the head portion does not protrude, and, in combination with a projecting centering or positioning flange or guide sleeve, described below, prevents the cracking or fracturing of the plastic arm 24 during installation and use, for all normal stress and strain associated with normal use, and allows for the same mounting screw 18, 20 to be used, and not a longer one, since the opening 30 may be countersunk to the degree above-mentioned. This centering flange or sleeve is indicated by reference numeral 32 in FIGS. 2, 3 and 4, and is a substantially frustro-conically shaped member defining canted or sloped circumferential outer surface 32' extending a complete 360 degrees. This flange 32 terminates on the exterior side thereof, facing the wall, and defines the exterior hole 30''. The protruding flange or beaded portion 32 is used as a centering aid in that it mates with and is inserted into the countersunk opening 22 of the wall plate, thus aiding in the installation of the protector 10, and also providing greater strength to the lever 24, so that the pressure from the tightened mounting screw 18 does not cause fracturing of the protector 10. The sleeve 32 also serves as a fulcrum or pivot by which the lever 24 is rotated, for reasons discussed below in greater detail.

The lower end 28 of the arm 24 is formed into a beveled surface 36, which beveled surface faces exteriorly, or toward the wall plate 14. The beveled surface 36 serves multifarious functions. Firstly, it makes the thickness of the lower end of the protector 10 less than the upper end thereof, whereby the lower end of the protector 10 may be allowed to clear the rotary portion 16' (FIG. 1) of the light switch, which rotary portion projects outwardly from the wall plate 14. This allows the lower edge surface 36' to contact the toggle or lever 16 proper, in order to prevent its rotational movement, to thereby keep the toggle 16 in the desired state thereof, and to prevent the "protected-against state" from being achieved. The angle of slope of the beveled surface 36 is preferably between 10 and 35 degrees, though other values may be appropriate, also. The beveled surface 36 has the additional function of providing a surface that may be gripped by a finger, by which the arm 24 proper may be slightly pulled away from the wall, toward the interior of the room, in order to bypass any obstruction associated with the protruding molding 14' of the light switch, which molding defines the rectangular opening through which projects the toggle 16 and associated rotary hub 16'. The beveled surface allows, also, for easy gripping so that the protector 10 may be rotated about the mounting screw via the projecting flange or beaded portion 32, in order to allow for the "protected-against" state to be achieved, and to return the protector back to its original position for preventing access to the "protected-against" state. Since the protector 10 is made of plastic, there is inherent flexibility, allowing for the flexing of the arm 24 when the beveled surface 36 is pulled by a finger in order to pull the end 28 of the protector 10 away from the wall plate during installation and also during rotation thereof in a plane parallel to the wall plate in order to move the protector 10 between its operative and inoperative states. One additional function of the beveled surface 36 is to provide for the cutting down of the lever 24 to a desired length in order to accomodate non-standard light switches, or light switches having three states thereof: "on", "off" and "middle", such as SPDT switch. The narrower end of the beveled surface allows for such easy cutting down to length.

Figure 1:
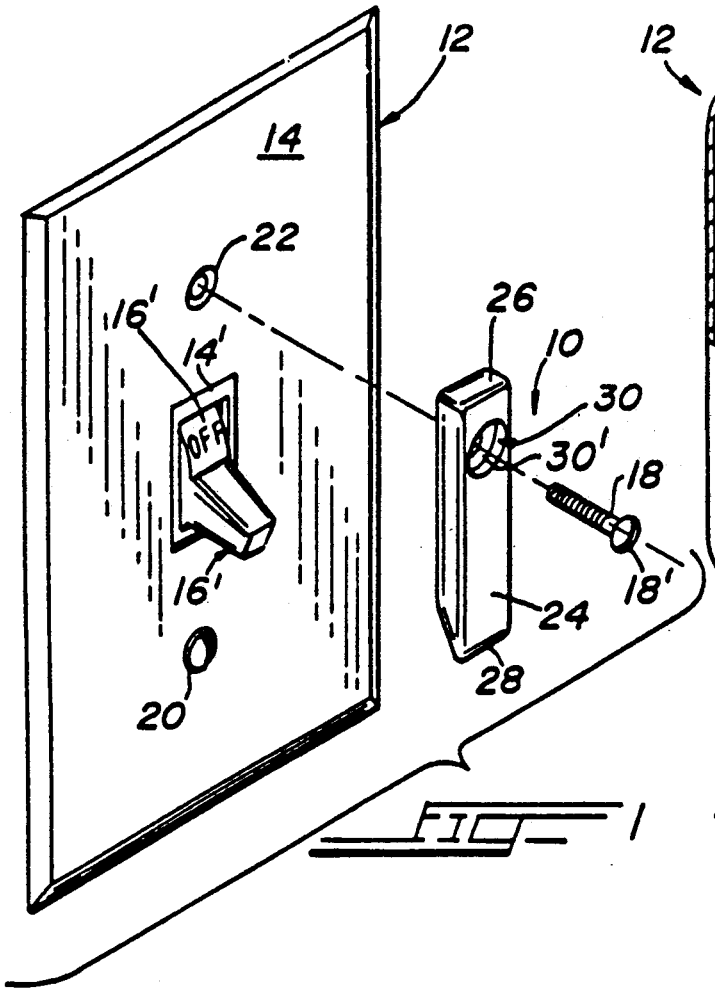
FIG. 1 is an isometric view showing the switch-guard of the present invention and its attachment to a wall-mounted toggle switch.
Figure 2:
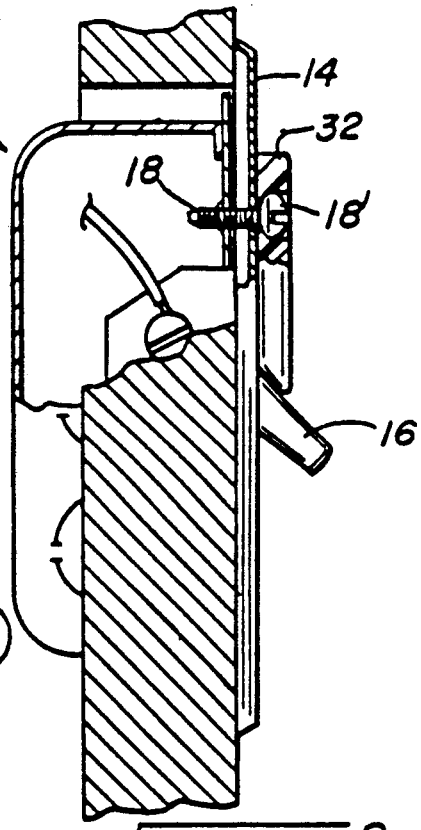
FIG. 2 is a longitudinal cross-sectional view of a toggle light-switch incorporating therein the switch-guard of the present invention.
Figure 3:
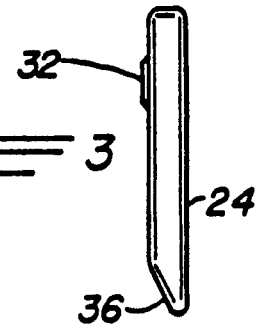
FIG. 3 is a side elevation view of the switch-guard of the present invention.
Figure 4:
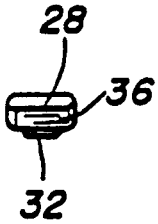
FIG. 4 is a bottom view thereof.
Figure 5:
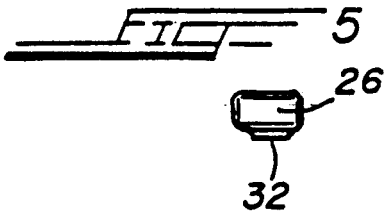
FIG. 5 is a top view thereof.
Figure 8:
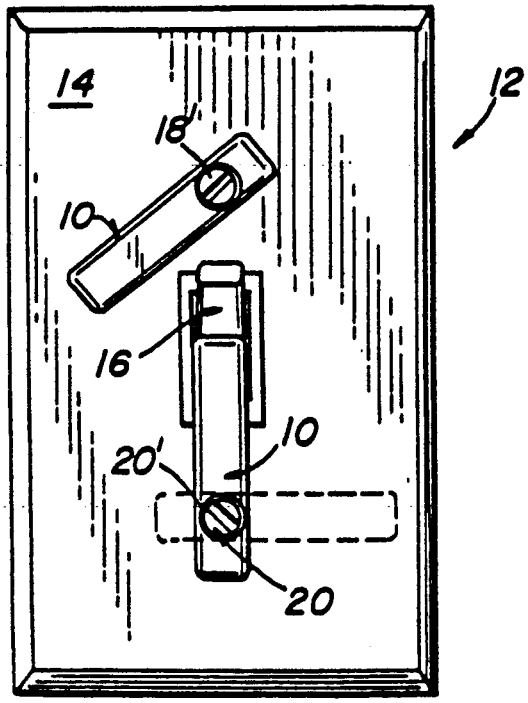
FIG. 8 is front view of a wall-mounted switch incorporating two switch-guards of the present invention for protecting both the "on" and "off" states.

The protector 10 is used as follows. Assuming the light switch 12 is to be protected such that the toggle 16 cannot be pivoted upwardly to its "on" position, the mounting screw 18 is removed from the wall plate 14, and then inserted through the countersunk opening 30 and flange 32, and then screwed back into the wall plate hole 22, as shown in FIG. 1. The mounting screw 18 is tightened an amount such that the head portion 18' thereof is received within the opening 30, such tightening also being to the degree such that the protector 10 may be rotated parallel to the wall plate to the desired degree of difficulty or facility. Firstly, the screw 18 is not tightened all the way, so that the protector 10 may be positioned vertically, as shown in FIG. 2, in order to prevent the toggle from pivoting upwardly. Thereafter, the screw 18 may be further tightened in order to prevent the easy pivotal movement of the protector, whereby a child or elderly person may be prevented from pivoting the protector 10, or where even an average adult may not be able to pivot the protector without first loosening the screw 18. Thus, upon initial installation, the screw may be tightened to allow for pivotal movement of the protector to its inoperative state without having to first loosen the screw, or upon installation, the screw may be so tightened as to require subsequent loosening of the screw if pivotal movement of the protector is to be possible. Thus, it may be seen, that the degree of protection and the ease of overcoming such protection of the protector of the present invention is continuously adjustable and alterable. If the "protected-against" state is the "off" position, as may occur when one desires that an apparatus not be allowed to be shut off, the mounting screw 20 would be used, as shown in dotted lines in FIG. 8, with the canted or beveled surface 36 and end 28 of the protector 10 extending upwardly. If both "on" and "off" states of the switch are to be protected, so that the switch may be alternatively protected for one state or the other as desired, two protectors 10 may be used, as shown in FIG. 8.

Figure 9:
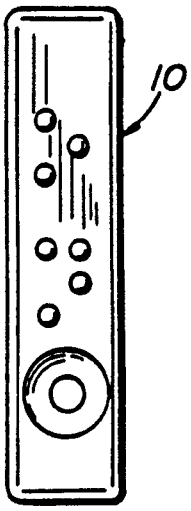
FIG. 9 is a front view of the switch-guard of the present invention in which Braille identifying marks are provided on the front surface so that a blind person may determine what switch he or she is about to operate.
Figure 10:
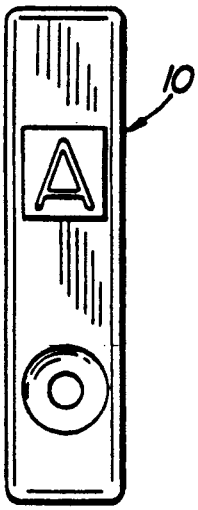
FIG. 10 is a front view of the switch-guard of the present invention in which a different of identifying material is provided on the front surface of the guard, in order to label a switch.

The protector 10 may also be used in wall-mounted light switch in which the mounting screws are not placed vertically apart but horizontally apart, with the toggle or toggles 16 rotatable in the vertical direction, which toggles are positioned between the two mounting screws. In this use, the toggle closest to the screw may be protected against its "on" state when the mounting screw is tightened a requisite degree to prevent its rotational movement. Each protector used may be appropriately labeled, such as with a letter, as shown in FIG. 10, in order to label the particular switch of the multi-switch arrangement. Such a plurality of protectors 10 may also be used for multi-switch arrangements where there are provided a pair of vertically-arranged mounting screws 18, 20 for each toggle switch 12, again each protector 10 being appropriately labeled on its front or interiorly-facing surface, as shown in FIG. 10. Furthermore, the protector 10 may be ideally suited to blind persons, with the front surface of the protector 10 being provided with braille (FIG. 9) in order to inform the blind person what switch he or she is about to operate. Since it is possible to move the protector 10 between its operative and inoperative states without the need of tools, the blind person may easily locate the switch desired, as well as protect or unprotect it, as desired. It is also possible to mark each protector 10 such that a person in a dark room may know which switch he is about to operate.

Modifications of the protector 10 are possible. FIG. 11 shows one such modification where the front or interiorly-facing surface of the protector 10' is provided with a knurled finger-grip 42 defining a main body portion 44 attached at one end thereof to the side of the front surface of the protector, and a bent or right-angle portion 46 having a knurled face. The finger-grip 42 allows for easier impartation of rotational movement to the protector 10'. A variation of the finger-grip is shown in FIG. 12, where the finger grip 48 projects centrally of the front surface of the protector 10". The finger-grip 48 has two bent or right-angle portions 50, 52 in order to allow for a finger to rotate the protector in either direction by pushing on the finger-grip 48. In both FIGS. 11 and 12, the protector is shown mounted to a switch in order to protect the switch from being turned off.

FIG. 13 shows a different use of the protector 10 of FIGS. 1-8. In this use, the switch being protected is a push-button switch 54, such as those found in light dimmer switches. The protector 10 is mounted in the same manner as that shown in FIGS. 1-8 via a mounting screw 18'. However, in this use, the thickness of the protector 10 is utilized in order to prevent the switch operating button 56 from being pushed. The state to be protected against may be either the "on" or "off" state, with the protector 10 being installed when the switch 54 is in its desired state. Rendering the protector inoperative is carried out in the same manner by simply rotating it out of position. Protectors 10' and 10" may also be used with push button switches 54. In addition, telescoping sleeves may also be provided to fit over the end 28 of the protector 10 in order to increase the thickness thereof, so that different strokes of various push-button switches may be accomodated. The user may, alternatively, simply use tape for increasing the thickness of the end 28.

Still another modification of the protector of the invention is shown in FIGS. 14 and 15. The protector 60 is similar to the protector 10, with the difference being that the protector 60 is provided with a weighted element 62 forming part of the arm 61 proper. Thus, the protector 60 is not one integral, molded piece. The weighted element 62 adds additional weight to the lower or canted end of the protector 10, in order to cause the arm 61 to tend to its operative, vertically-oriented position, so that the protector 60 automatically returns to its protective state after having been rotated to allow for the "protected-against" state to have been achieved. The mounting screw pivotally mounting the protector 60 must, of course, be accordingly rotated to the desired degree allowing of the free rotation of the protector 60, so that the protector 60 is an automatic, self-return switch guard. An alternative automatic, self-returning protector is one utilizing a spring (not shown) which biases the protector into its operative, protective state. Remote control of the protector 10—10" and 60 is also possible using well-known remote-control techniques operating a solenoid. In addition, a mercury switch may be provided on the protector for indicating the state thereof via an audio or video signal device coupled to the mercury switch.

Figure 17:
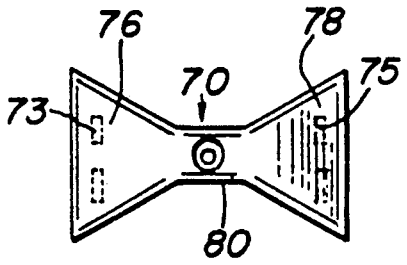
FIG. 17 is a front view of the outlet-guard of the second embodiment of the present invention used for protecting two side-by-side outlets simultaneously.
Figure 18:
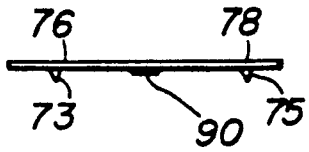
FIG. 18 is a side elevational view thereof.
Figure 19:
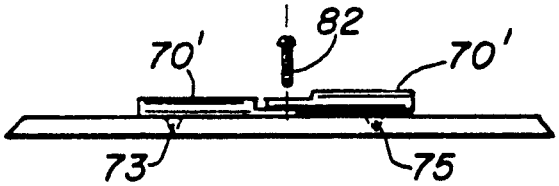
FIG. 19 is a side elevational view showing a modification of the outlet-guard of the second embodiment of the present invention, with the outlet-guard thereof closing off only one female plug outlet, but capable of being combined to close off two side-by-side outlets.
Figure 20:
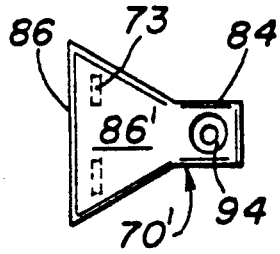
FIG. 20 is a front view of the modified outlet-guard of FIG. 19.
Figure 21:
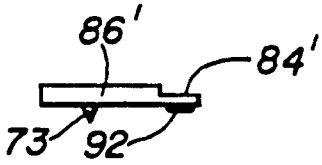
FIG. 21 is a side elevational view thereof.

The same general concept is applicable to the protection of a wall plug outlet, as shown in FIGS. 16-21. A wall plug protector 70 is shown in FIG. 17 for protecting the common, standard type of outlet in which there are provided a pair of female outlets 72, 74, as shown in FIG. 16. The outlet protector 70 is provided with a pair of arms 76, 78, and a central connecting portion 80, in which central portion is formed a central hole through which passes the wall outlet mounting screw 82, whereby the protector 70 may be pivoted into and out of its operative, protective state. The protector 70 either simultaneously protects or allows access to both female outlets 72, 74. A variation of the protector 70 is the protector 70' shown in FIGS. 19-21, which protector 70' protects only one of the outlets 72, 74. The protector 70' has a first end portion 84 substantially rectangular in shape which has a central hole for the passage therethrough of a mounting screw 82 of the wall plug. Protector 70' also has a second end portion 86 which actually closes off access to the female plug outlet 72 or 74. In both plug outlet protectors 70, 70', the end portions thereof that actually close off the plug are shown substantially as trapezoidal shapes. However, any shape may be used as long as the female plug outlet is closed off and denied access. Each of the plug outlet protectors 70, 70' is also provided with a central pivot sleeve or flange 90, 92, respectively, which serve the same function as the sleeve or flange 32 of the protector 10. The primary difference between the protectors 70 and 70' is that use of two protectors 70' for the wall outlet allows for independent and selective protection of each of the female outlets 72, 74, whereas the protector 70 offers only both outlets protected or both unprotected. Two such outlet protectors 70' may be used to protect the pair of outlets 72, 74 by inserting the sleeve or flange 92 of the first protector 70' into the countersunk opening 94 of the other protector 70', in the manner shown in FIG. 19, with the mounting screw 82 passing interiorly through both of the sleeves 92 stacked one inside the other. In order to allow for such stacking, the rectangular end portion 84 is narrowed as clearly shown in FIG. 21, so that the interior-facing surface 84' is offset from the interior-facing surface 86' of the trapezoidal-shaped end portion 86. Thus, when stacked, as shown in FIG. 19, the combined thicknesses of the end portions 84 total the thickness of the end portion 86. It is also noted that when the protectors 70, 70' are rotated into their inoperative state, the narrower portions 80 and 84 do not interfere with the insertion of the male plug into the respective female plug outlet. Also, regarding the protector 70, such may be readily transformed into one protector 70' by cutting along a line outside of the countersunk opening thereof. Each of the protectors 70, 70' is also preferably provided with a pair of parallel, inwardly-facing, interior beads or ribs 73, 75 spaced apart substantially the same distance as the two female plug-openings of the outlet. Each rib or bead 73, 75 preferably has downwardly tapering side surfaces so as to form a relatively tipped lower end for insertion into a respective slot of the female plug-outlet. The pair of side sloped or tapered side surfaces are spaced apart and converge in a direction transverse to the length of the slots of the wall outlet. Each rib or bead 73, 75 serves to space the protector 70, 70' proper from the wall outlet to allow for easier gripping when it is desired to pivot the protector to its unprotecting state, and also prevent accidental pivoting thereof owing to the fact that the beads 73, 75 are at least partially inserted in the slots of the wall outlet. The sloped or tapered side surfaces of the beads 73, 75 act as camming surfaces allowing for the insertion of the respective bead into a slot of the outlet as well as the removal therefrom during the rotation of the protector 70, 70' in one direction or the other, these sloped side surfaces also preventing the complete insertion of the bead into a slot of the outlet so as to ensure that the protector 70, 70' proper is spaced away from contact with the surface of the wall outlet, as explained above.

It is noted that the type of end portion 84 with recessed interior-facing surface 84' may also be used in the protector 10, allowing for the stacking thereof in the same manner. This stacking capability also may be used for storing the protectors during the shipment and inventory stages thereof, as well as for display and packaging. The protector 70 may also be cut so as to be formed into one protector, if desired.

Figure 22:
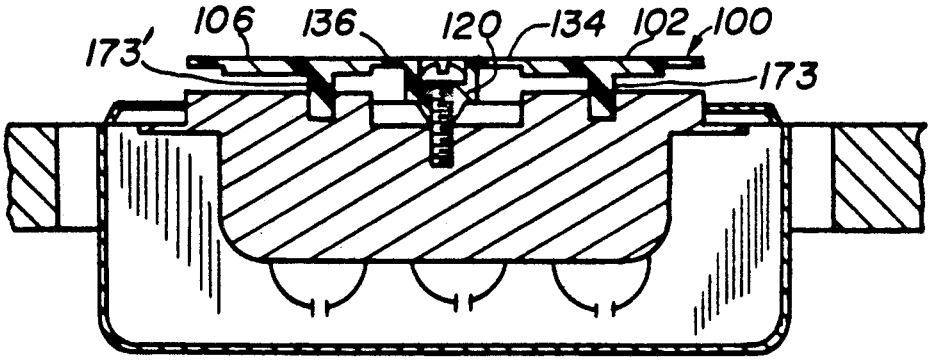

FIGS. 22–29 show another modification of the outlet guard 100, which in the embodiment shown is a double-piece guard 102, 106 with each end of each piece being thinner than the rest of the piece to allow for gripping thereof by a finger when required to rotate it. The shape of each piece is pentagonal rather than triangular, and each piece has a pair of interiorly-facing beads or ribs 173, 173' similar to the ribs 73 but not tapered like the ribs 73, which ribs 173, 173' fit into the power and neutral terminals of the conventional wall outlet. It is noted that the piece 102 has a rounded end-edge 104 while the piece 106 has a straight end-edge 108 indicating the upper and lower wall outlets to which each is respectively inserted. The ribs 173' are spaced farther away from the respective 108 than are the beads 173' from its respective end-edge 104 to accomodate wall outlets having a third, ground terminal, since the power and neutral terminals of one outlet will be spaced farther than those of the other outlet with respect to the central mounting screw (FIG. 27). Each pair of beads are spaced apart the same distance with respect to the longitudinal center line of the guard. The outlet guard 100 may be made of "ZYTEL ST101", manufactured by Dupont, which is a nylon material. Polyurethane may also be used. With regards to the central beaded portion 120, through which the mounting screw of the wall outlet plate passes, which is similar to the other embodiments above-described, it is noted that the plane containing therein the annular flat surface 124 abuts against the face plate of the outlet when mounted thereto. Depending upon the type of outlet, the annular flat surface 124 may abut against the face plate such that the beads 173, 173' do not project fully into the terminals, as shown in FIG. 22, so that the ends of the pieces of the guard are easily grasped by a finger to rotate it; or, for other types of outlets, the annular flat surface may abut against the wall face plate such that the beads project completely into the terminals, causing the inner planar surface of each piece to lie flush against the respective outlet, in which case the thinner ends of the two pieces allow for easy gripping by a finger for rotating the guard in the manner above-described (FIG. 24). The material of which the guard is made, as above-described, is flexible, with the flexible pivots of each piece 102, 106 being provided at the flat connecting webs 134, 136 between the central beaded portion 120 and the respective pieces. FIG. 23 shows the guard 100 flexed at both end edges for rotating it, such flexing being about the webs 134, 136. Instead of a double-piece guard, separate or individual pieces 200 and 300 may be used, as shown in FIGS. 25, 26, 28 and 29. Any shaped end-edge, besides rounded or straight, may be used to identify the upper or lower piece, or the like. It is also noted that the spaced-version shown in FIG. 22 is the preferred, since it requires less flexing or bending of the guard. In the version of FIG. 24, additional flexing is necessary, which could cause the double-piece guard 100 to assume its flexed shape of FIG. 22, over prolonged use.

While a specific embodiment of the invention has been shown and described, it is to be understood that numerous changes and modifications may be made therein without departing from the scope, spirit and intent of the invention as set forth in the appended claims.

What I claim is:

1. In a wall plug outlet comprising a mounting plate having at least one mounting hole, at least one female plug outlet, and a mounting screw for said mounting hole, the improvement comprising:

a protective guard for said at least one female plug outlet, said guard comprising a main elongated portion comprising a first female plug-outlet cover portion for selectively closing off access to said at least one female plug outlet, and a second mounting portion connected to said first portion, said second portion having a through-opening formed therein for receiving therethrough said mounting screw, said guard being pivotally mounted to said wall plate via said mounting screw for a selected degree of difficulty of rotation thereof accomplished via the degree of tightening of said mounting screw in said mounting hole of said wall plate, whereby said guard may alternatively close off access to said female plug outlet and allow access thereto;

said second portion comprising a rearwardly projecting bead defining a hollow interior in direct alignment with said through-opening, said bead projecting from the rear surface face of said second portion, whereby said bead may project into said mounting hole of said wall plate, said mounting screw passing through said through-opening and said bead, said bead adding structural integrity to said main elongated portion and providing a seat during the rotation thereof; said bead comprising an outer frustro-conical circumferential surface, said outer surface capable of mating with the interior circumferential surface of said mounting hole of said mounting plate.

2. The improvement according to claim 1, wherein said second portion comprises a front surface face that is offset from the front surface face of said first portion to define a step therebetween, whereby two said guards may stacked one above the other by inserting one said bead of one said guard into said through-opening of another said guard.

3. The improvement according to claim 1, wherein said wall outlet comprises two said female plug outlets arranged side-by-side, said guard further comprising a third, female plug-outlet cover portion for selectively closing off access to other of said female plug outlets, said first and third portions extending from opposite ends of said second portion such that said second portion is positioned in the middle between said first and third portions, whereby both said female plug outlets are simultaneously closed off to deny access, or simultaneously revealed to allow access, when said guard is rotated about said mounting screw.

4. A protective guard for a wall plug outlet, which outlet has a mounting plate having at least one mounting hole, at least one female plug outlet, and a mounting screw for the mounting hole, comprising:

a protective guard member for at least one female plug outlet, said guard member comprising a main elongated portion comprising a first female plug-outlet cover portion for selectively closing off access to at least one female plug outlet, and a second mounting portion connected to said first portion, said second portion having a through-opening formed therein for receiving therethrough a mounting screw, said guard member being capable of pivotal mounted to a wall plate via a mounting screw for a selected degree of difficulty of rotation thereof accomplished via the degree of tightening of the mounting screw in the mounting hole of the wall plate, whereby said guard member may alternatively close off access to a female plug outlet and allow access thereto;

said second portion comprising a rear surface face and a rearwardly projecting bead defining a hollow interior, said bead projecting from said rear surface face of said second portion, whereby said bead may project into a mounting hole of a wall plate, with the mounting screw passing through said bead, said bead adding structural integrity to said main elongated portion and providing a seat during the rotation thereof; said bead comprising an outer frustro-conical circumferential surface, said outer surface capable of mating with the interior circumferential surface of a mounting hole of a mounting plate.

5. The protective guard according to claim 4, wherein said first portion has a width at least at one part thereof greater than the greatest width of said second portion, whereby said second portion does not interfere with the insertion of a male plug into said female plug outlet when said guard is rotated into its inoperative state.

6. The protective guard according to claim 4, wherein said second portion comprises a front surface face that is offset from the front surface face of said first portion to define a step therebetween, whereby two said guards may stacked one above the other by inserting one said bead of one said guard into said through-opening of another said guard.

7. The protective guard according to claim 4, wherein said guard further comprises a third, female plug-outlet cover portion for selectively closing off access to another female plug outlet, said first and third portions extending from opposite ends of said second portion such that said second portion is positioned in the middle between said first and third portions, whereby two female plug outlets may be simultaneously closed off to deny access, or simultaneously revealed to allow access, when said guard is rotated.

8. A protective guard for a wall plug outlet, which outlet has a mounting plate having at least one mounting hole, a pair of female plug outlets, and a mounting screw for the mounting hole, comprising:

a protective guard for the pair of female plug outlets, said guard comprising a first female plug-outlet cover portion for selectively closing off access to one of said pair of female plug outlets, a second female plug-outlet cover portion for selectively closing off access to other of said pair of female plug outlets, and a third mounting portion connecting said first and second cover portions together, said third mounting portion having a through-opening formed therein for receiving therethrough a mounting screw; said first, second and third portions being integrally connected to each other;

said first cover portion comprising a main body portion having a connecting part connected to said third mounting portion and an edge-surface spaced from said connecting part, said first cover portion also comprising an interior surface, and at least one rib projecting from said interior surface, said at least one rib being capable of being received in one of the power and neutral terminals of a conventional wall plug outlet, said at least one rib being spaced a specified distance from the center of said through-opening of said third mounting portion;

said second cover portion also comprising a main body portion having a connecting part connected to said third mounting portion and an edge-surface spaced from said connecting part, said second cover portion also comprising an interior surface, and at least one rib projecting from said interior surface, said at least one rib being capable of being received in the other of the power and neutral terminals of a conventional wall plug outlet, said at least one rib being spaced a specified distance from the center of said through-opening of said third mounting portion;

said specified distance of said at least one rib of said second cover portion being less than said specified distance of said at least one rib of said first cover portion in order to accommodate female plug outlets also having a ground terminal.

9. The protective guard according to claim 8, wherein said edge-surface of each of said first and second cover portions comprises a thickness less than the thickness of the remainder of the respective one of said first and second cover portions, so that, when the protective guard is mounted to wall outlet, each said edge-surface is spaced from the wall outlet for providing easier gripping thereof.

10. The protective guard according to claim 8, wherein said third mounting portion comprises an inner surface face and a rearwardly projecting bead defining a hollow interior, said bead projecting from said the rear surface face, whereby said bead may project into a mounting hole of a wall plate, with the mounting screw passing through said bead, said bead adding structural integrity and providing a seat during the rotation of the guard; said bead comprising an outer frustro-conical circumferential surface, said outer surface capable of mating with an interior circumferential surface of a mounting hole of a mounting plate.

11. The protective guard according to claim 8, wherein said first cover portion has a first geometric shape in order to indicate to which one of the plug outlets it is to be associated, and said second cover portion having a second geometric shape different from said first geometric shape to indicate association with the other of the plug outlets.

12. The protective guard according to claim 11, wherein each of said first and second cover portions comprises two ribs for the power and neutral terminals of a female plug outlet.

* * * * *